US005182931A

United States Patent [19]

Noé et al.

[11] Patent Number: 5,182,931

[45] Date of Patent: Feb. 2, 1993

[54] METHOD FOR CONTINUOUS TENSION STRETCHING OF THIN STRIPS, PARTICULARLY METAL STRIPS

[75] Inventors: Oskar Noé; Rolf Noé; Andreas Noé, all of Mülheim, Fed. Rep. of Germany

[73] Assignee: BWG Bergwerk-und Walzwerk Maschinenbau GmbH, Duisberg, Fed. Rep. of Germany

[21] Appl. No.: 481,983

[22] Filed: Feb. 16, 1990

[30] Foreign Application Priority Data

Apr. 18, 1989 [DE] Fed. Rep. of Germany ..... 3912676

[51] Int. Cl.[5] ..... B21D 3/12

[52] U.S. Cl. ..... 72/183; 72/160

[58] Field of Search ..... 72/205, 183, 160, 161, 72/41; 29/132

[56] References Cited

U.S. PATENT DOCUMENTS 4,408,474 10/1983 Hutzenlaub et al. ..... 72/205
4,819,470 4/1989 Noé et al. ..... 72/183
4,861,549 8/1989 Khare ..... 72/132

FOREIGN PATENT DOCUMENTS 3312181 10/1984 Fed. Rep. of Germany ..... 72/160

*Primary Examiner*—Lowell A. Larson
*Assistant Examiner*—Michael J. McKeon
*Attorney, Agent, or Firm*—Anderson, Kill, Olick & Oshinsky

[57] ABSTRACT

A method and an arrangement for continuous tension stretching of thin metal strips. The strip is conducted through a set of brake rollers and a set of pull rollers and the strip is subjected to a stretch-forming or stretch pull operation between the two sets of rollers for stretching the strip in the plastic range, wherein the stretch pull force corresponds to the yield point of the strip material. The strip is subjected between the set of brake rollers and the set of pull rollers only to a stretch-pull which is required for stretching the strip in the plastic range. As a result, transverse elongation during plastic stretching is minimized, so that center troughs no longer occur and, when the strip is longitudinally divided, the strip portions no longer have unequal side lengths.

2 Claims, 3 Drawing Sheets

METHOD FOR CONTINUOUS TENSION STRETCHING OF THIN STRIPS, PARTICULARLY METAL STRIPS

BACKGROUND OF THE INVENTION

1. Field of the Invention

The present invention relates to a method for continuous tension stretching of thin strips, particularly metal strips of steel, aluminum or other metals having a thickness of between 0.05 mm and 0.5 mm. The method includes passing the strip through a set of brake rollers and a set of pull rollers and subjecting the strip to a stretch pull or stretch-forming operation between the two sets of rollers during stretching of the strip in the plastic range. The stretch pull force corresponds to or slightly exceeds the yield point of the strip material.

The present invention also relates to an arrangement for carrying out the above-described method.

2. Description of the Related Art

Thin metal strip is leveled by means of tension stretching arrangements with a set of brake rollers and a set of pull rollers. Both sets of rollers have two or more rollers to which staggered torques and, thus, stretch-forming forces are applied, so that finally the stretch pull or stretch-forming force required for the desired stretching is achieved between the set of brake rollers and the set of pull rollers.

During the stretching procedure, the plastic elongation of the strip is obtained by reducing the strip thickness and strip width. While the reduction of strip thickness is not impaired during the stretching procedure, the reduction of strip width is impaired in transverse direction because of the friction between the strip and the rollers, so that transverse tensions are built up from the strip edge toward the strip center with the result that greater plastic deformations occur in the middle portion of the strip than in the edge portions of the strip. In fact, the reduction of the strip width in transverse direction is particularly impaired because of attempts to build up high stretch-forming forces within as few rollers as possible and, consequently, rollers are used whose outer roller surfaces are provided with a friction lining of rubber, plastics material or the like. The last roller of the set of brake rollers and the first roller of the set of pull rollers have to transmit the maximum stretch-forming force to the strip in accordance with a staggering of the coefficient of friction $e^{\mu\alpha}$. The stretch-forming forces to be generated are always adjusted in such a way that the respective yield point of the strip is reached between the last brake roller and the first pull roller and a strip elongation occurs which is freely selectable. The resulting longitudinal tensions cause the above-mentioned transverse tensions which depend on the strip material. The ratio of $\epsilon_{transverse}$ to $\epsilon_{longitudinal}$, the so-called Poisson coefficient $\mu$, is in the range of between 0.25 to 0.3 in the case of metals.

If a longitudinal tension is applied to a strip, the strip is constricted in the elastic range as well as in the plastic range. The transverse tensions are built up increasingly from the edge to the center of the strip because the strip is prevented from transverse sliding on the rollers. In connection with the longitudinal tensions, this results in greater longitudinal deformations in the center of the strip. This is true for the elastic deformation as well as for the plastic deformation, so that more-or-less pronounced troughs are formed in the strip center which are not acceptable, particularly in strips to be used for lithographic purposes. In addition, during stretching in the plastic range, residual tensions occur in longitudinal direction which are uniformly distributed over the width of the strip.

If such a strip is cut into longitudinal strip portions to be used for different printing sizes, the edges in the center are slightly longer than the edges at the outside. This is also an undesirable effect. This effect is compounded by the fact that the strip can be pressed into the elastic coating of the roller surfaces, so that the strip edges at the edge portions of the strip are forced with greater force into the roller surface than are the middle strip portions.

It is, therefore, the object of the present invention to provide a method and an arrangement for continuous tension stretching of thin strip, particularly metal strip, of the above-described type in which the transverse changes of the strip occurring during plastic stretching are reduced to a minimum and, thus, the formation of center troughs and residual tensions non-uniformly distributed over the width of the strip are essentially eliminated.

SUMMARY OF THE INVENTION

In the method of the above-described type, the object of the invention is met by subjecting the strip to a stretch pull or stretch-forming operation required only for its stretching in the plastic range in a pair of tension stretching rollers arranged between the set of brake rollers and the set of pull rollers.

In accordance with a feature of the invention having independent significance, approximately 5% to 25% of the maximum stretch pull for the plastic stretching is applied by the pair of tension stretching rollers and 75% to 95% of the maximum stretch pull for the elastic stretching of the strip is generated by the set of brake rollers and the set of pull rollers.

Accordingly, the present invention provides that the set of brake rollers and the set of pull rollers generate that stretch pull which is required for the elastic deformation of the continuous strip. Thus, the rollers of the set of brake rollers and of the set of pull rollers perform a relatively high portion of the stretch pull. However, this is not troublesome because the strip is not subjected to a permanent transverse change during the elastic deformation. On the other hand, the plastic deformation of the strip during the stretching procedure is carried out only within the pair of tension stretching rollers which perform the remaining and relatively low portion of the stretch pull. Consequently, the stretch pull required for the desired stretching of the strip is distributed to the set of brake rollers and the set of pull rollers for the elastic stretching, on one hand, and the pair of tension stretching rollers for the plastic stretching of the strip, on the other hand.

In this connection, the invention starts from the finding that only a relatively low portion of the tension is required for stretching in the plastic range, i.e., to reach or possibly slightly exceed the yield point of the strip material. With the modulus of elasticity being predetermined by the strip material, this results in a correspondingly low transverse stretching. This, in turn, results in a relatively uniform distribution of the tension over the width of the strip, so that center troughs are practically no longer formed and there is no longer the danger that after longitudinally dividing the strip, the strip portions have sides of different lengths. Consequently, an excellent product is obtained which is suitable even for lithographic purposes.

A tension stretching arrangement which is suitable for carrying out the method according to the invention essentially includes a set of brake rollers and a set of pull rollers. The improvement provided by the invention is a pair of tension stretching rollers arranged between the set of brake rollers and the set of pull rollers. The set of brake rollers, the pair of tension stretching rollers and the set of pull rollers may be tension mounted in the known manner.

In order to minimize transverse changes in the strip during the plastic stretching and, consequently, in the area of the pair of tension stretching rollers by means of a suitable roller construction, the present invention further provides that the tension stretching rollers have metal shells, the surfaces of which are hardened or provided with a hard coating and have a very fine finish. As a result, the friction between the strip and the pair of tension stretching rollers is minimized to such an extent that frictional influences can no longer cause transverse tensions which increase from the strip edge to the strip center; rather, an essentially uniform distribution of tension over the width of the strip is achieved.

In this connection, the invention provides that the roller shells of the tension stretching rollers are of a metal alloy having a low coefficient of friction, such as, austenitic cast iron with flake graphite or globular graphite, bronze alloys or the like. This simultaneously facilitates sliding without a tendency to erode. The sliding effect can be further optimized by applying to the tension stretching rollers preferably an anti-friction agent, for example, an oil emulsion which simultaneously prevents loose particles from sticking to the rollers.

In accordance with an advantageous feature of the invention, the diameter of the tension stretching rollers is 1500 times greater than the maximum strip thickness, so that bending on the tension stretching rollers contributing to the plastic tension stretching has only a slight influence on the longitudinal curvature or planeness.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawings.

DESCRIPTION OF THE PREFERRED EMBODIMENT

Figure 1:
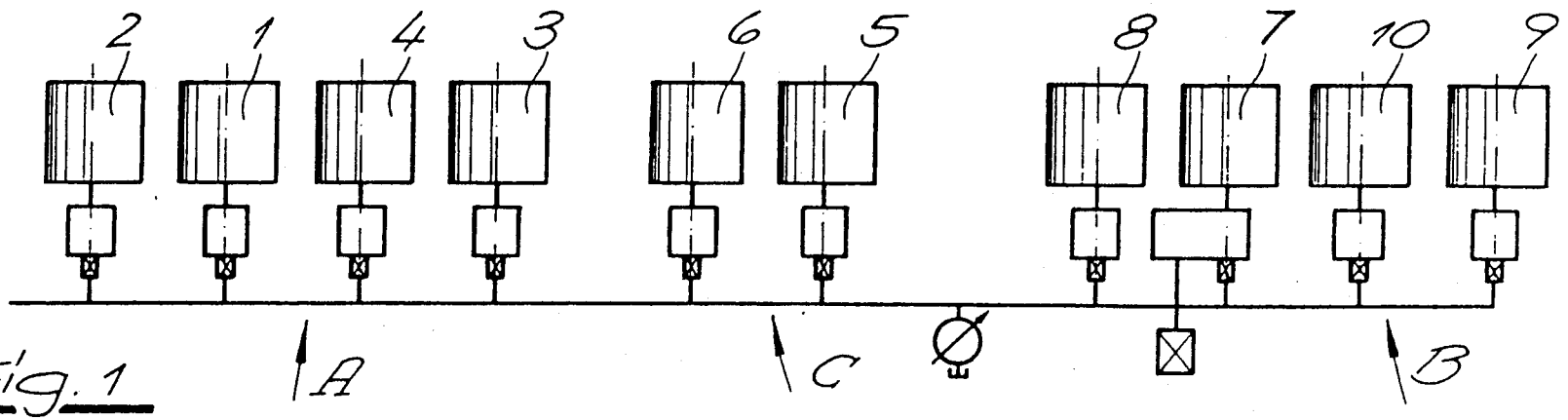
FIG. 1 is a schematic top view of the tension stretching arrangement according to the present invention with a hydraulic tension mounting.
Figure 2:
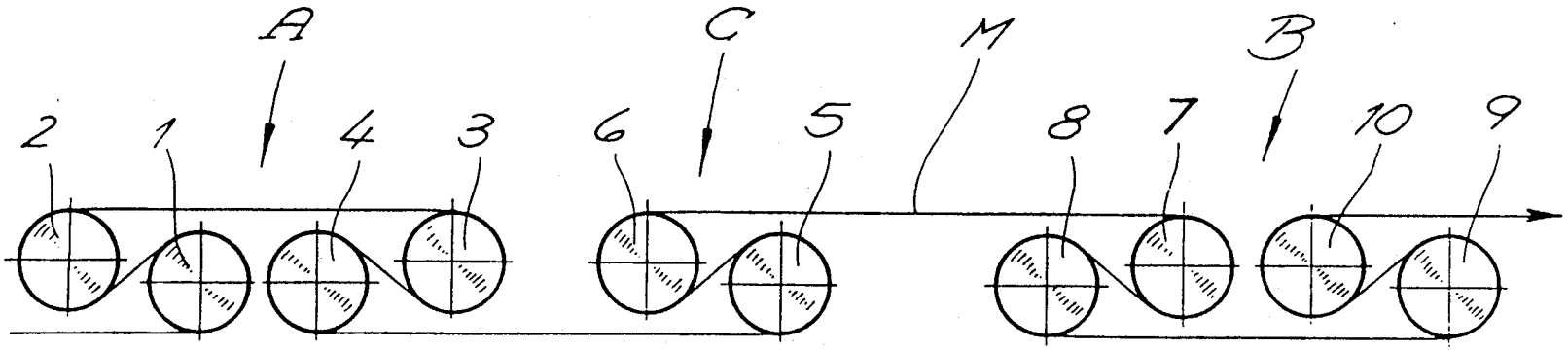
FIG. 2 is a side view of the arrangement of FIG. 1 without the mounting.
Figure 3:
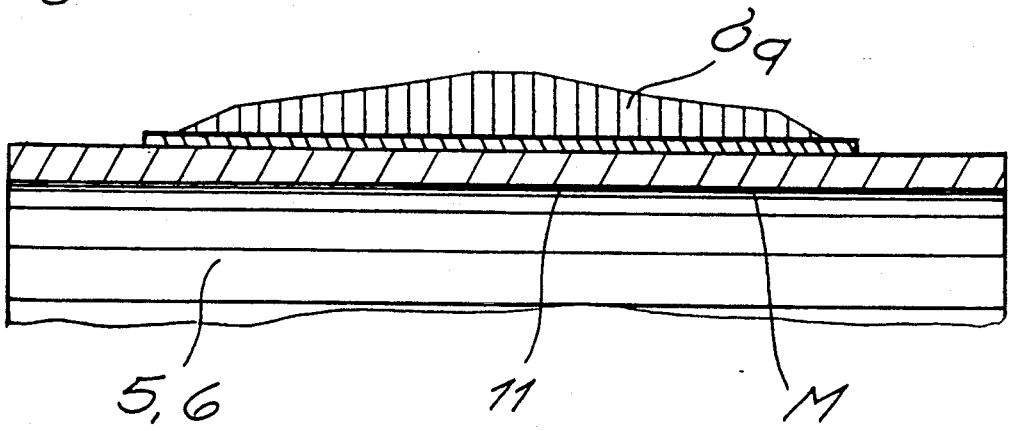
FIG. 3 is a cross-sectional view of a metal strip on a roller having an elastic roller shell and the resulting tension build up during the stretching procedure.
Figure 4:
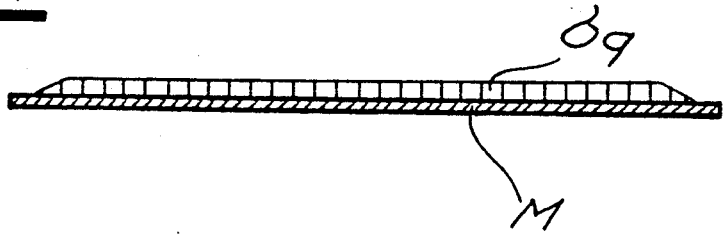
FIG. 4 is a cross-sectional view of a metal strip on a tension stretching roller according to the present invention with an anti-friction roller shell and the tension build up according to the invention during the stretching procedure.

The figures of the drawing show a tension stretching arrangement for the continuous tension stretching of thin metal strip M particularly of steel, aluminum or the like, having a strip thickness of between 0.05 mm and 0.5 mm. The tension stretching arrangement is essentially composed of a set A of brake rollers 1, 2, 3, 4 and a set B of pull rollers 7, 8, 9, 10. A pair C of tension stretching rollers 5, 6 is arranged between the set A of brake rollers and the set B of tension rollers. At least the tension stretching rollers 5, 6 have metal roller shells 11. The surfaces of the shells 11 are hardened or provided with a hard coating and are provided with a very fine finish. Specifically, the roller shells 11 may be of a metal alloy having a low coefficient of friction, such as, austenitic cast iron with flake graphite or globular graphite, bronze alloys or the like. A lubricant may be applied to the tension stretching rollers 5, 6. The diameter of the tension stretching rollers 5, 6 is selected 1500 times greater than the maximum strip thickness.

Within the scope of the invention, the set A of the brake rollers and the set B of the tension rollers can have two or more rollers. The rollers may be tension mounted in the known manner.

EXAMPLE

It shall be assumed that the stretch pull required for the desired tension stretching is 16 t. In addition, the yield point of the strip material shall be reached when the stretch pull is 16 t, i.e.

$$16\ t \simeq 100\%\ \sigma s$$

In the case of aluminum as the strip material, $\sigma s = 20$ kp/mm$^2$ and the modulus of elasticity $E = 6900$ kp/mm$^2$. In a conventional tension stretching arrangement, i.e., without the intermediate arrangement of a pair C of tension stretching rollers, the stretch pull distribution shall be as follows:

| Roller | Sz | $\Delta_{Sz}$ |
|---|---|---|
| 1 | −2 t | 1 t |
| 2 | −4 t | 2 t |
| 3 | −8 t | 4 t |
| 4 | −16 t | 8 t |
| 5 | +16 t | 8 t |
| 6 | +8 t | 4 t |
| 7 | +4 t | 2 t |
| 8 | +2 t | 1 t |

In this case, the following longitudinal and transverse elongations occur:

Rollers 4/5 $\Delta S_z = 8\ t \simeq 50\%\ \sigma S = 10$ kp/mm$^2$

Longitudinal elongation $\epsilon_l = 10/6900 = 0.00145$

Transverse elongation $\epsilon_q = 0.000435$ with $\mu = 0.3$

Length change/1000 mm $\Delta L = 1.45$ mm

Width change/1000 mm $\Delta B = 0.435$ mm

The stretch pull distribution with a pair C of tension stretching rollers in accordance with the present invention is as follows:

| Roller | Sz | $\Delta_{Sz}$ |
|---|---|---|
| 1 | 2 t | 1 t |
| 2 | 4 t | 2 t |
| 3 | 8 t | 4 t |

-continued

| Roller | Sz | $\Delta_{Sz}$ |
|---|---|---|
| 4 | 15.2 t | 7.2 t |
| 5 | 16.0 t | 0.8 t |
| 6 | 16.0 t | 0.8 t |
| 7 | 15.2 t | 7.2 t |
| 8 | 8 t | 4 t |
| 9 | 4 t | 2 t |
| 10 | 2 t | 1 t |

Rollers 5/6 $\Delta S_z = 0.8$ t $\simeq 5\%$ $\sigma S = 1$ kp/mm$^2$
Longitudinal elongation $\epsilon_l = 1/6900 = 0.000145$
Transverse elongation $\epsilon_q = 0.0000435$
with $\mu = 0.3$
Length change/1000 mm $\Delta L = 0.145$ mm
Width change/1000 mm $\Delta B = 0.0435$ mm It is immediately clear from this example that the transverse elongation per 1000 mm strip width is greater by the factor 10 in the conventional tension stretching arrangement than in the arrangement according to the invention. In fact, the arrangement of the present invention reduces the transverse elongation by the factor 1/10 because between the set A of brake rollers and the set B of pull rollers, the strip is subjected in the intermediate pair C of tension stretching rollers only to a stretch pull which is required for stretching in the plastic range, namely approximately 5% to 25% of the maximum stretch pull for the plastic stretching, while the sets of brake rollers and pull rollers produce 75% to 95% of the maximum stretch pull, but only for the elastic stretching of the strip.

Figure 5:
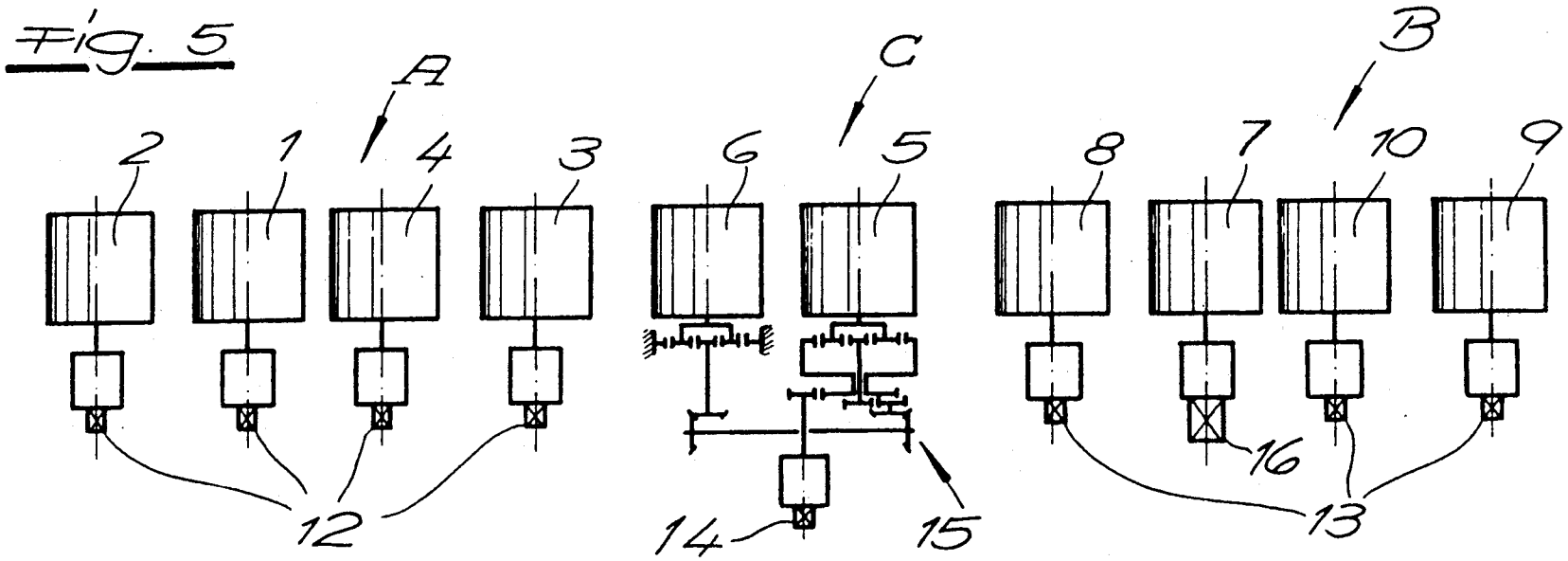
FIG. 5 is a schematic top view of a modified tension stretching arrangement according to the present invention.

FIG. 5 of the drawing shows a tension stretching arrangement of independent significance. In this arrangement, tension-controlled brake drives 12 act on the brake rollers 1, 2, 3, 4 and tension-controlled tension drives 13 act on the pull rollers 7, 8, 9, 10 and a speed-controlled stretch drive 14 acts on the tension stretching rollers 5, 6 with the intermediate arrangement of a superimposed gear assembly 15. A speed-controlled main motor 16 acts on the tension rollers 7 as speed master for the set B of tension rollers. Thus, in this tension stretching arrangement, the set A of brake rollers and the set B of pull rollers are tension-controlled, while the pair C of tension stretching rollers is connected through a differential gear assembly and the stretch drive 14 generates as tension motor the desired degree of stretching through speed control. Accordingly, plastic stretching occurs when the stretch drive 14 operates. The stretch drive 14 is adjusted with the percentage portion of the rate of rotation of the main motor 16 in accordance with the roller diameters and the gear ratios, so that the stretch drive 14 produces a uniform tension stretching over the entire speed range. The superimposed gear assembly 15 is composed essentially of a planetary gear assembly and a bevel wheel connecting shaft which supports the tension stretching rollers 5, 6.

While the invention has been illustrated and described as embodied in a method and arrangement for continuous tension stretching of thin strips, it is not intended to be limited to the details shown, since various modifications and structural changes may be made without departing in any way form the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

We claim:

1. In a method for continuous tension stretching of thin metal strips of steel, aluminum and like metals having a thickness of between 0.05 mm and 0.5 mm, the method including passing the strip through a set of brake rollers and a set of pull rollers and subjecting the strip to a stretch pull operation between the two sets of rollers for stretching the strip in the plastic range, wherein the stretch pull force corresponds to or slightly exceeds the yield point of the strip material, the improvement comprising subjecting the strip to a stretch pull operation required for stretching the strip in the plastic range in a pair of tension stretching rollers arranged between the set of brake rollers and the set of pull rollers and subjecting the strip to a stretch pull operation required for stretching the strip in the elastic range in the set of brake rollers and the set of pull rollers.

2. The method according to claim 1, wherein 5% to 25% of the stretch pull force for plastic stretching are produced by the pair of tension stretching rollers and 75% to 95% of the stretch pull force for elastic stretching of the strip are produced by the set of brake rollers and the set of pull rollers.

* * * * *